US010077975B2

(12) United States Patent
Haas

(10) Patent No.: US 10,077,975 B2
(45) Date of Patent: Sep. 18, 2018

(54) BROADHEAD HAVING AN ADJUSTABLE CUTTING DIAMETER

(71) Applicant: FeraDyne Outdoors LLC, Superior, WI (US)

(72) Inventor: Matthew Peter Haas, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 0 days.

(21) Appl. No.: 15/377,290

(22) Filed: Dec. 13, 2016

(65) Prior Publication Data

US 2017/0176154 A1 Jun. 22, 2017

Related U.S. Application Data

(60) Provisional application No. 62/268,789, filed on Dec. 17, 2015.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583, 584
See application file for complete search history.

(56) References Cited

U.S. PATENT DOCUMENTS 4,210,330 A * 7/1980 Kosbab ..... F42B 6/08 473/584
4,976,443 A * 12/1990 DeLucia ..... F42B 6/08 473/583
5,066,021 A * 11/1991 DeLucia ..... F42B 6/08 473/583
5,417,440 A * 5/1995 Barrie ..... F42B 6/08 473/584
5,482,293 A * 1/1996 Lekavich ..... F42B 6/08 473/584
6,077,180 A * 6/2000 Adams, Jr. ..... F42B 6/08 473/584
6,595,881 B1 * 7/2003 Grace, Jr. ..... B22F 3/22 473/583
7,011,589 B2 * 3/2006 Davis ..... F42B 6/08 473/584
7,708,659 B2 * 5/2010 Grace, Jr. ..... F42B 6/08 473/584
7,771,298 B2 * 8/2010 Pulkrabek ..... F42B 6/08 473/583
8,096,905 B1 * 1/2012 Gillig ..... F42B 6/08 473/584
8,105,187 B1 * 1/2012 Sanford ..... F42B 6/08 473/583
8,182,378 B1 * 5/2012 Futtere ..... F42B 6/08 473/583
8,506,431 B2 * 8/2013 Green ..... F42B 6/08 473/584

(Continued)

*Primary Examiner* — Alexander Niconovich

(74) *Attorney, Agent, or Firm* — Winthrop & Weinstine P.A.

(57) ABSTRACT

A broadhead having an adjustable cutting diameter includes a collar and a plurality of adjustable blades having a cutting edge and a plurality of notches on a proximal or trailing edge of each blade. The collar and each notch on the proximal edge of each blade are configured for engagement or coupling with each other. The cutting diameter of the broadhead is adjusted by changing the notch that engages with the collar.

19 Claims, 12 Drawing Sheets

(56) References Cited

U.S. PATENT DOCUMENTS

| | | | | |
|---|---|---|---|---|
| 8,894,519 | B2 * | 11/2014 | Young | F42B 6/08 473/583 |
| 9,068,806 | B2 * | 6/2015 | Pedersen | F42B 12/34 |
| 2013/0190112 | A1 * | 7/2013 | Pedersen | F42B 6/08 473/583 |
| 2014/0179467 | A1 * | 6/2014 | Pedersen | F42B 6/08 473/583 |
| 2016/0084622 | A1 * | 3/2016 | Ford | F42B 12/34 473/583 |
| 2017/0191808 | A1 * | 7/2017 | Grace | F42B 6/08 |

* cited by examiner

BROADHEAD HAVING AN ADJUSTABLE CUTTING DIAMETER

CROSS-REFERENCE TO RELATED APPLICATIONS

This application claims the benefit of U.S. Provisional Patent Application No. 62/268,789 filed Dec. 17, 2015, the entirety of which is hereby incorporated by reference.

STATEMENT REGARDING FEDERALLY SPONSORED RESEARCH OR DEVELOPMENT

Not applicable.

TECHNICAL FIELD

The instant disclosure relates to broadheads, and more particularly to a fixed blade broadhead having an adjustable cut diameter.

BACKGROUND

With conventional broadheads, a user does not have the ability to adjust the cutting diameter of a blade. Accordingly, there exists a need for providing the user the ability to adjust the cutting diameter of the blade.

SUMMARY

A non-limiting exemplary embodiment of a broadhead having an adjustable cutting diameter includes a broadhead body, a plurality of blades, and a collar. The broadhead body includes a shaft having a distal end and a proximal end, wherein the distal end is configured for penetrating a target. The shaft additionally includes a plurality of longitudinally extending recesses. Each of the plurality of blades includes a longitudinally extending edge disposed within one of the plurality of recesses, a distal end pivotally attached to the shaft proximate the distal end or tip of the shaft, a proximal edge extending outwardly from the longitudinal edge of the blade, a plurality of notches disposed along the proximal edge of the blade, and an outwardly directed cutting surface. The collar is adjustably disposed about the shaft of the broadhead body proximate the proximal end of the broadhead body, and is configured for engaging with one of the plurality of notches disposed along the proximal edge of each of the plurality of blades.

A non-limiting exemplary embodiment of a method of adjusting a cutting diameter of a broadhead includes providing a broadhead body, providing a plurality of blades, and providing a collar. The broadhead includes a shaft having a distal end and a proximal end, wherein the distal end is configured for penetrating a target. The shaft additionally includes a plurality of longitudinally extending recesses. Each of the plurality of blades includes a longitudinally extending edge disposed within one of the plurality of recesses, a distal end pivotally attached to the shaft proximate the distal end or tip of the shaft, a proximal edge extending outwardly from the longitudinal edge of the blade, a plurality of notches disposed along the proximal edge of the blade, and an outwardly directed cutting surface. The collar is adjustably disposed about the shaft of the broadhead body proximate the proximal end of the broadhead body, and is configured for engaging with one of the plurality of notches disposed along the proximal edge of each of the plurality of blades. The method of adjusting the cutting diameter of the broadhead further includes disengaging the collar from each of the notches, adjusting a cutting diameter of each of the plurality of blades by rotating the blade about its distal end, and engaging the collar with one of the plurality of notches disposed along the proximal edge of each of the plurality of blades.

DETAILED DESCRIPTION

One or more non-limiting embodiments are described herein with reference to the accompanying drawings, wherein like elements are designated by like numerals. It should be clearly understood that there is no intent, implied or otherwise, to limit the disclosure in any way, shape or form to the embodiments illustrated and described herein. While multiple exemplary embodiments are described, variations thereof will become apparent or obvious. Accordingly, any and all variants for providing functionalities similar to those of the described embodiments are considered as being within the metes and bounds of the instant disclosure.

Figure 1A:
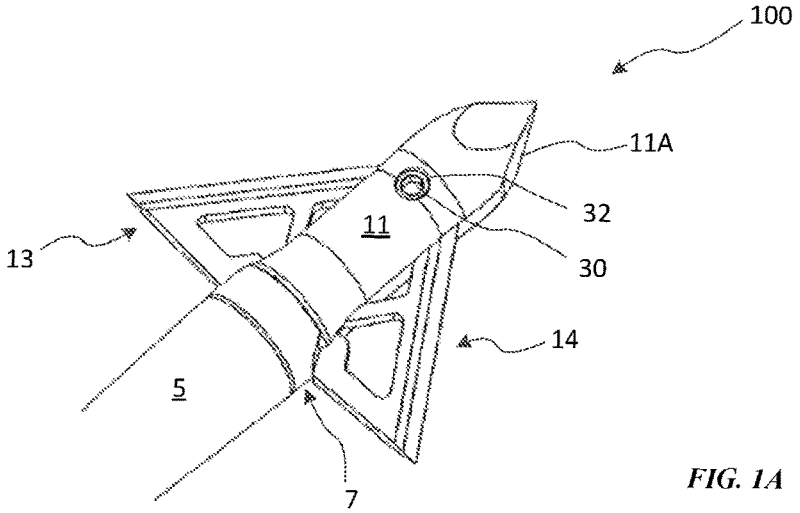
FIG. 1A is a perspective view of a non-limiting exemplary embodiment of a two-bladed broadhead held by a notch and collar, mounted to an arrow or crossbow bolt, with the blades in a first cutting diameter position.

FIG. 1A is a perspective view of a non-limiting exemplary embodiment of a two-bladed broadhead 100 having blades 13 and 14 in a first cutting diameter position. The blades 13 and 14 are held or retained in the first cutting diameter position by respective notches 13*a* and 14*a* mated or engaged with a collar 7. As described below, the notches 13*a*-13*c* and 14*a*-14*c* on the proximal ends or edges of the respective blades 13 and 14 are configured to mate or engage with the collar 7. The blade 13 is likewise held in the first cutting diameter position by the notch 13*a* mating or engaging with the collar 7.

Figure 1B:
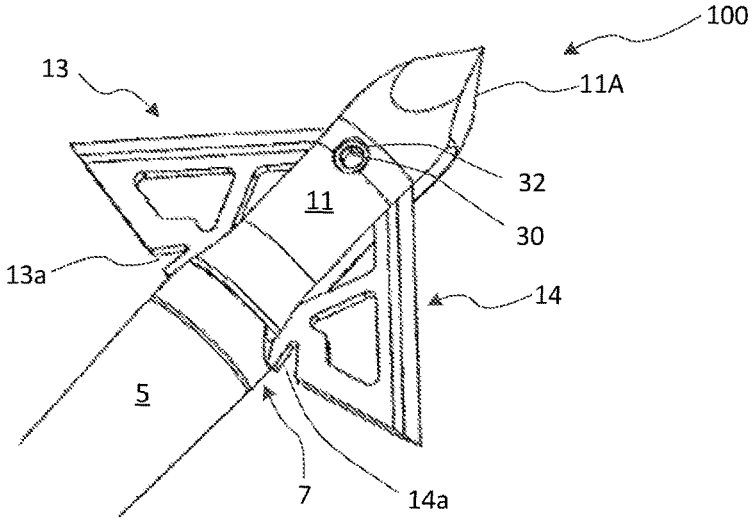
FIG. 1B is a perspective view of the two-bladed broadhead FIG. 1A with the blades in a second cutting diameter position.
Figure 1C:
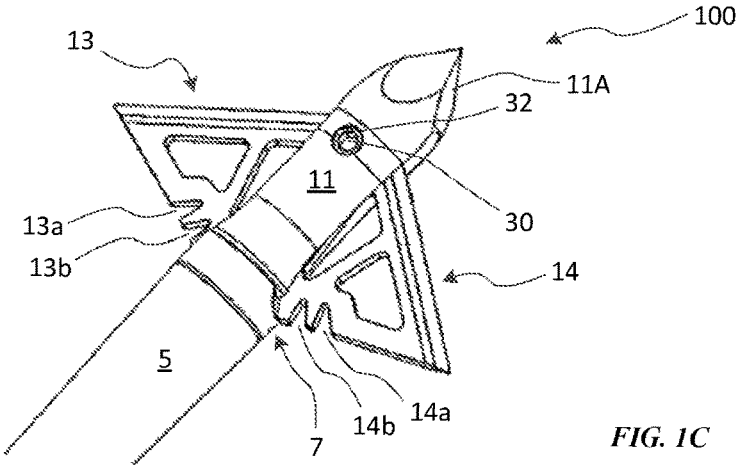
FIG. 1C is a perspective view of the two-bladed broadhead of FIG. 1A with the blades in a third cutting diameter position.

FIG. 1B is a perspective view of the two-bladed broadhead 100 of FIGS. 1A and 1C with the blades 13 and 14 held in the second cutting diameter position by respective notches 13*b* and 14*b* mated or engaged with the collar 7. FIG. 1C is a perspective view of the two-bladed broadhead 100 of FIGS. 1A and 1B with the blades 13 and 14 held in the third cutting diameter position by respective notches 13*c* and 14*c* mated or engaged with the collar 7.

Figure 2A:
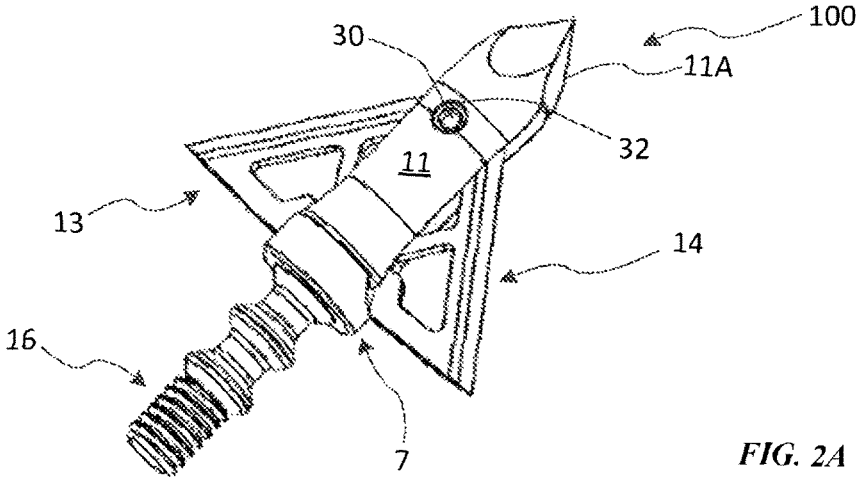
FIG. 2A is a perspective view of a non-limiting exemplary embodiment of a two-bladed broadhead with a notched collar positioned over a threaded portion of the rear arrow shaft attachment end, holding the blades in a first cutting diameter position.
Figure 2B:
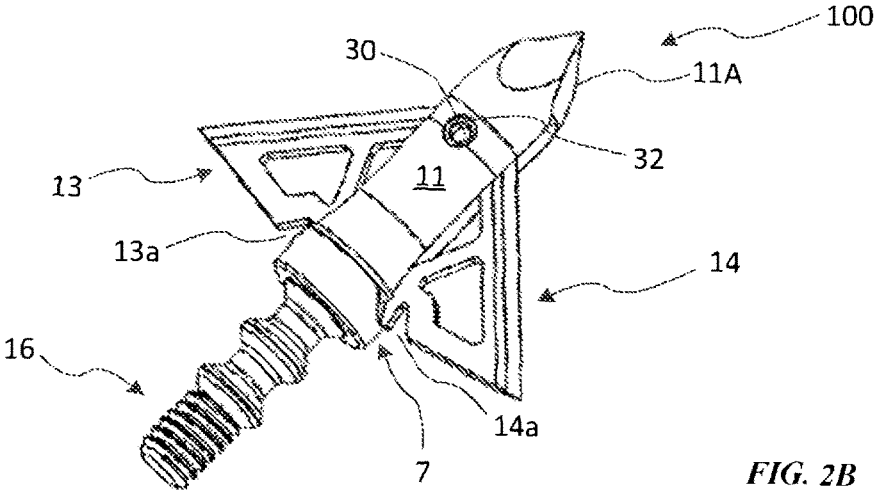
FIG. 2B is a perspective view of the two-bladed broadhead of FIG. 2A with the blades held in a second cutting diameter position.
Figure 2C:
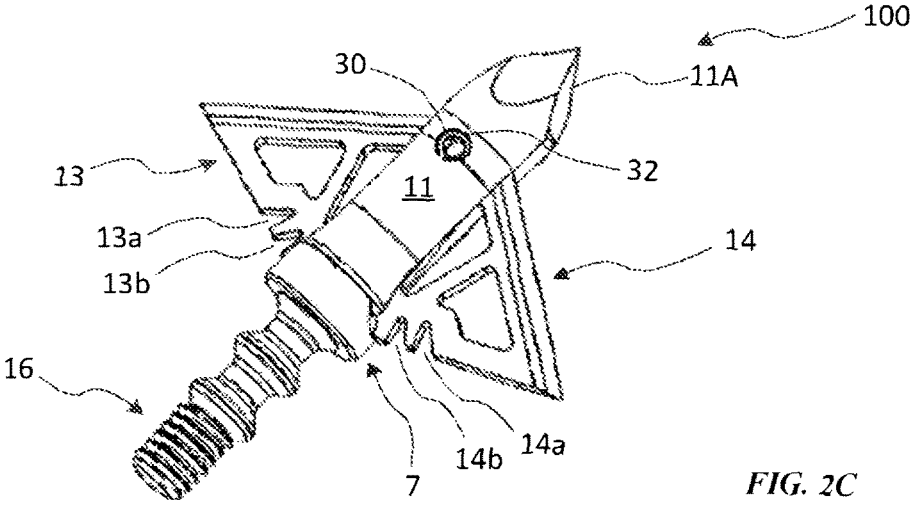
FIG. 2C is a perspective view of the two-bladed broadhead of FIG. 2A with the blades held in a third cutting diameter position.

FIG. 2A is a perspective view of another non-limiting exemplary embodiment of the two-bladed broadhead 100 with the blades 13 and 14 in the first cutting diameter position. The blades 13 and 14 are held in the first cutting diameter position by respective notches 13*a* and 14*a* mated or engaged with the collar 7. FIG. 2B is a perspective view of the two-bladed broadhead 100 of FIGS. 2A and 2C with the blades 13 and 14 held in the second cutting diameter position by respective notches 13*b* and 14*b* mated or engaged with the collar 7. FIG. 2C is a perspective view of a two-bladed broadhead 100 of FIGS. 2A and 2B with the blades 13 and 14 held in the third cutting diameter position by respective notches 13*c* and 14*c* mated or engaged with the collar 7.

In order to enable positioning and re-positioning the blades 13 and 14 between the first, second and third cutting diameter positions, in some non-limiting exemplary embodiments, such as those illustrated in FIGS. 1A-1C and 2A-2B, at least a distal portion or end of the blades 13 and 14 opposite the proximal ends or edges having the notches 13*a*-13*c* and 14*a*-14*c* are pivotally attached to a broadhead body 11 of the two-bladed broadhead 100 by a pin 30 extending through a bore 32 disposed transversely through the body 11. In some embodiments, the distal portions or ends of the blades 13 and 14 are pivotally attached by a set screw 30. In certain embodiments, the distal ends or portion of the blades 13 and 14 are pivotally attached by other suitable means such as a dowel pin or a roll pin.

In certain non-limiting exemplary embodiments of the two-bladed broadhead 100, such as those illustrated in FIGS. 1A-1C and 2A-2C, the broadhead body 11 includes a front target penetrating end 11*a*. The target penetrating end 11*a* may be any of several known forms such as conical, faceted, straight taper or razor insert tip blade.

Figure 4:
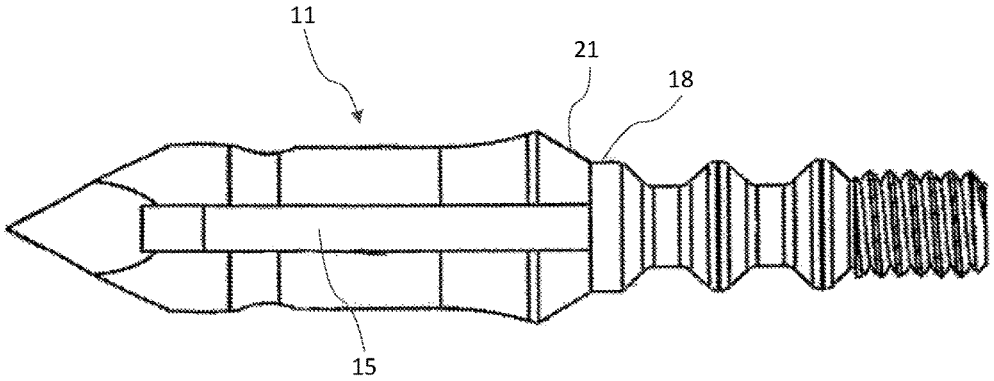
FIG. 4 is a side view of a non-limiting exemplary embodiment of a ferrule or body of a two-bladed broadhead without the collar or blades.
Figure 5:
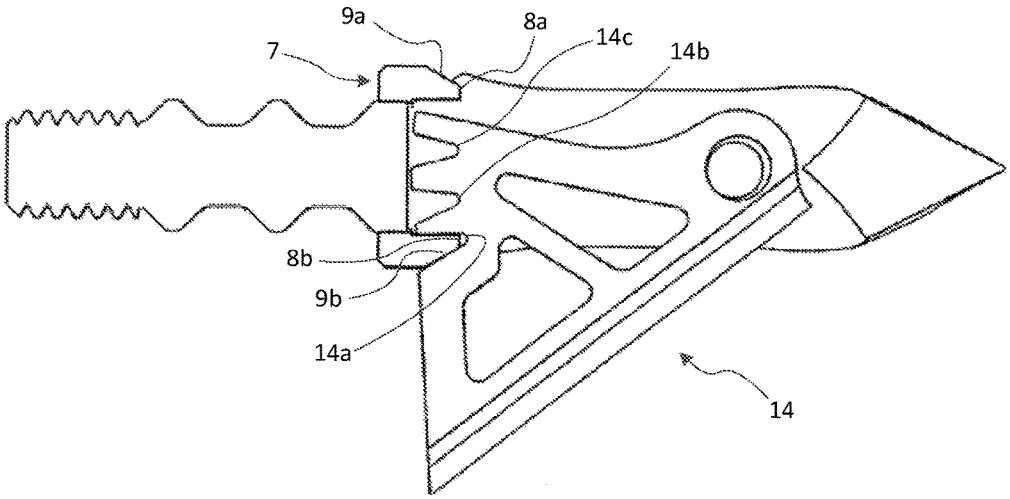
FIG. 5 is a cross-sectional view of the two-bladed broadhead and collar illustrated in FIGS. 1A-1C and 2A-2C with the collar engaged with a blade in one of three possible positions.

From FIGS. 1A-1C and 2A-2C, it should be apparent that the cutting diameter of the broadhead 100 is defined, at least in part, by the distance that the proximal edges or ends of the blades 13 and 14 extend away from the broadhead body 11. FIG. 4 illustrates a non-limiting exemplary embodiment of the broadhead body 11 having a longitudinally extending transverse passage 15. It should be noted that the blades 13 and 14 are not shown in FIG. 4 for the sole purpose of clearly illustrating and describing the embodiment. In a non-limiting exemplary embodiment, the passage 15 is configured for housing at least a portion of the blades 13 and 14. As illustrated in FIGS. 1A-1C and 2A-2C, the proximal edges or ends of the blades 13 and 14 extend farther away from the broadhead body 11 when in the third cutting diameter position than when in the second cutting diameter position. And, the proximal edges or ends of the blades 13 and 14 extend farther away from the broadhead body 11 when in the second cutting diameter position than when in the first cutting diameter position. Consequently, at least while in the first and the second cutting diameter positions, at least portions of the blades 13 and 14 need to recede into and housed within the passage 15. For instance, FIG. 5 illustrates a cross-sectional view of the broadhead 100 with the blade 14 in the first cutting diameter position. As shown, portions of the blade 14 encompassing the notches 14*b* and 14*c* extend through the passage 15 and are housed within the broadhead body 11. It should be noted that blade 13 is not illustrated in FIG. 5 for the sole purpose of clearly illustrating and describing the embodiment. While not shown, portions of the blade 13 encompassing the notches 13*b* and 13*c* also extend through the passage 15 and are housed within the broadhead body 11 when in the first cutting diameter position. In certain embodiments, at least some portions of the blades 13 and 14 are also housed within the passage 15 when in the third cutting diameter position.

In some non-limiting exemplary embodiments of the two-bladed broadhead 100, such as that illustrated in FIGS. 1A-1C, the collar 7 is mounted on a shaft of an arrow or on a crossbow bolt 5. In certain non-limiting exemplary embodiments of the two-bladed broadhead 100, such as that illustrated in FIGS. 2A-2C, the collar 7 is mounted on or positioned over a portion of a threaded attachment end 16 extending proximally from the broadhead body 11. The threaded portion of the attachment end 16 is configured for threadingly mounting the broadhead 100 to an arrow shaft or a broadhead bolt 5. In some non-limiting exemplary embodiments, the collar 7 is a notched collar 7 as described with reference to FIGS. 3A and 3B.

Figure 3A:
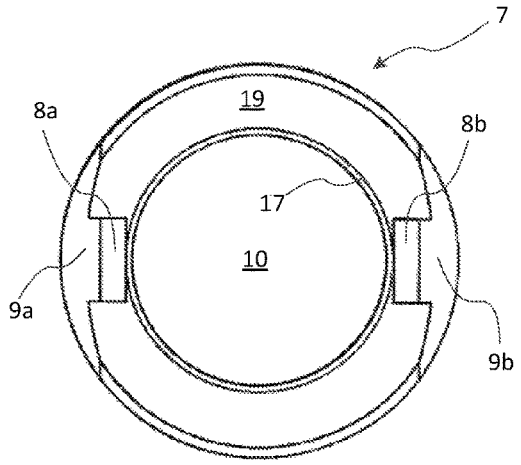
FIG. 3A is a top view of a non-limiting exemplary embodiment of a collar used to index and retain the blades on the two-bladed broadheads shown in FIGS. 1A-1C and 2A-2C.
Figure 3B:
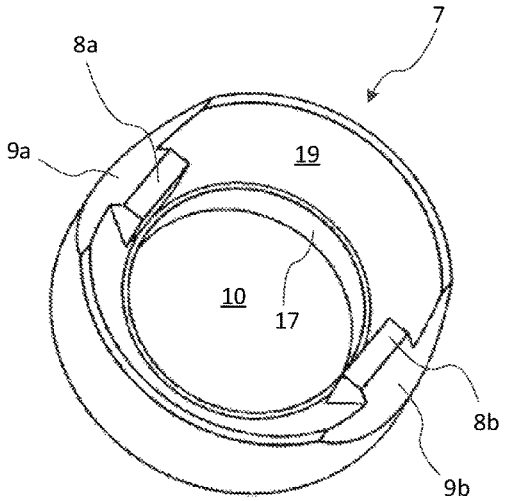
FIG. 3B is a perspective view of the collar illustrated in FIG. 3A.

FIG. 3A is a top view of a non-limiting exemplary embodiment of the collar 7 used for indexing and retaining the blades 13 and 14 in the first, second and third cutting diameter positions such as shown in FIGS. 1A-1C and 2A-2C. FIG. 3B is a perspective view of the collar 7 illustrated in FIG. 3A. Collar tab 8*a* and collar slope 9*a* mate and engage with notches 13*a*-13*c*, respectively, when the blade 13 is in the first, second and third diameter position. Likewise, collar tab 8*b* and collar slope 9*b* mate and engage with notches 14*a*-14*c*, respectively, when the blade 14 is in the first, second and third diameter position. For example, FIG. 5 illustrates collar tab 8*b* and collar slope 9*b* mated and engaged with notch 14*a* when the blade 14 is in the first cutting diameter position.

In some non-limiting exemplary embodiments, the collar 7 has an opening 10 that is adapted to receive the threaded attachment end 16 extending proximally from the broadhead body 11. The opening 10 is defined, at least in part, by an inner perimeter 17 of the collar 7. The inner perimeter 17 mates with a base portion 18 (FIG. 4) of the broadhead body 11. A sloped portion 19 of the collar 7 mates with a sloped portion 21 of the broadhead body 11. It should be apparent that a diameter of each of the sloped portion 19 and the sloped portion 21 varies or changes between their respective ends. In some non-limiting exemplary embodiments, the diameter of inner perimeter 17 is slightly larger than the diameter of the base portion 18, and the varying diameter of the sloped portion 19 is slightly larger than the varying diameter of the sloped portion 21. The collar 7 is thus adapted to securely fit over the base portion 18 and the sloped portion 21 of the broadhead body 11. In certain non-limiting exemplary embodiments, the diameter of inner perimeter 17 and the varying diameter of sloped portion 19 have approximately the same sized dimensions or slightly smaller dimensions than the respective diameters of base portion 18 and the sloped portion 21. Generally, the inner perimeter 17 resides or fits over the base portion 18, and the sloped portion 19 resides or fits over the sloped portion 21.

Figure 6A:
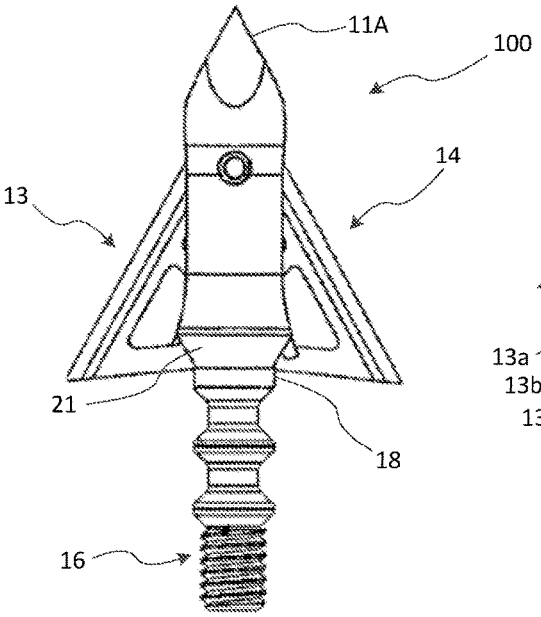
FIG. 6A is a side view of a non-limiting exemplary embodiment of a two-bladed broadhead without a notched collar, with the blades positioned in the narrowest cutting diameter position.
Figure 6B:
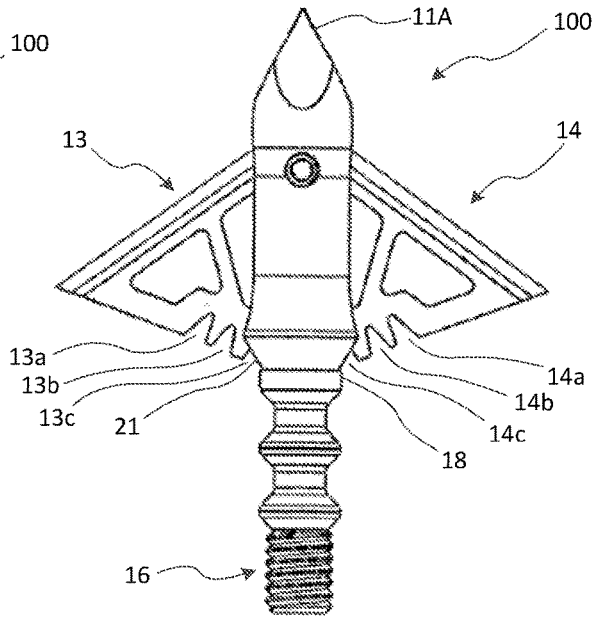
FIG. 6B is a side view of the two-bladed broadhead of FIG. 6A with the blades positioned in the widest cutting diameter position.

FIG. 6A is a side view of a non-limiting exemplary embodiment of the broadhead 100 without the collar 7 and with the blades 13 and 14 positioned in the narrowest cutting diameter position, e.g., in the first cutting diameter position. FIG. 6B is a side view of a non-limiting exemplary embodiment of the broadhead 100 without the collar 7 and with the blades 13 and 14 positioned in the widest cutting diameter position, e.g., in the third cutting diameter position.

Figure 7A:
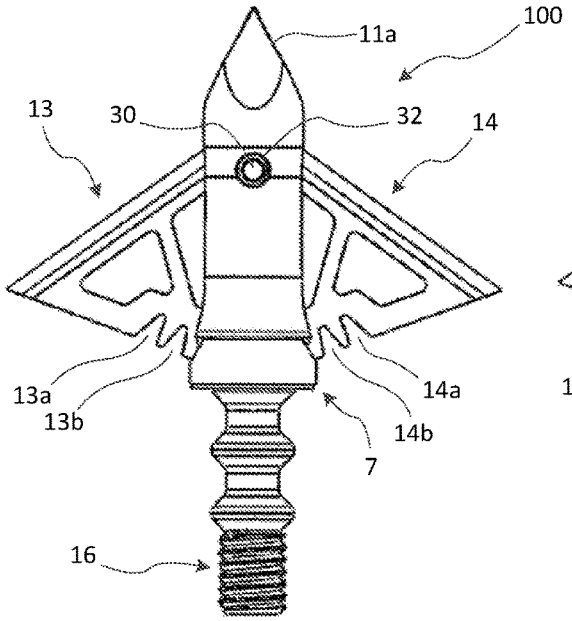
FIGS. 7A-7D illustrate a non-limiting exemplary embodiment of a process of moving the blades of the two-bladed broadheads of FIGS. 1A-1C and 2A-2C from one position to another.
Figure 7B:
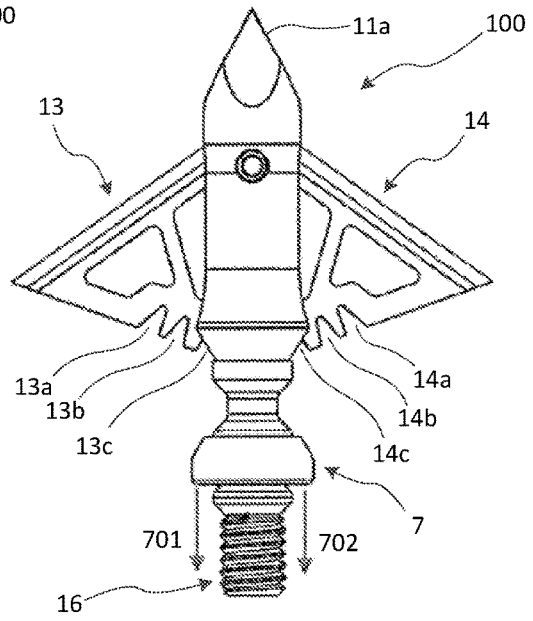
Figure 7C:
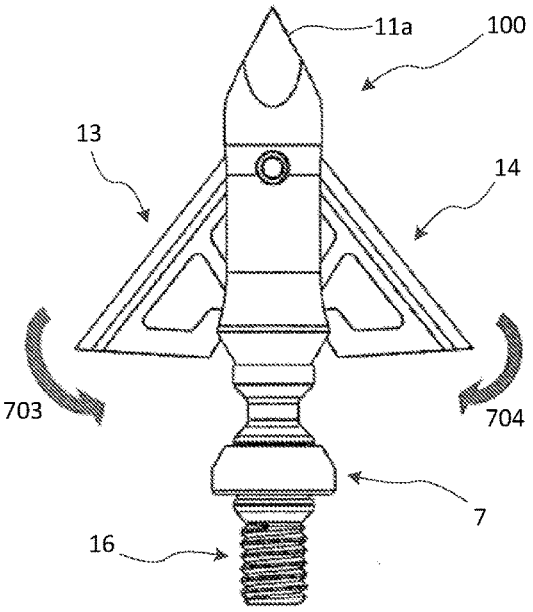
Figure 7D:
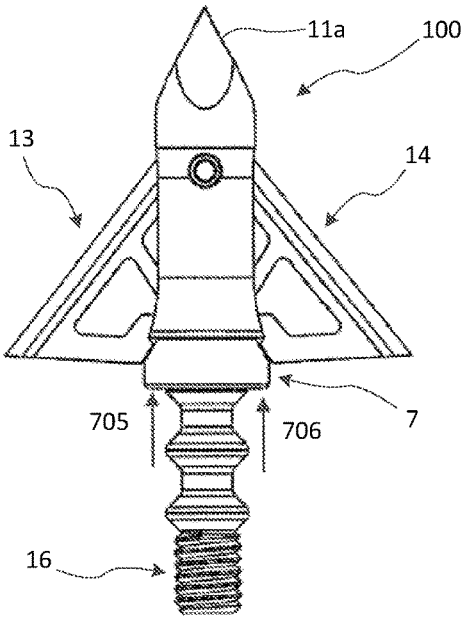

FIGS. 7A-7D illustrate a non-limiting exemplary embodiment of a method or process of moving the blades to and from one position to another in the two-bladed broadhead 100 illustrated in FIGS. 2A-2C. FIG. 7A shows the two-bladed broadhead 100 with the blades 13 and 14 in the widest, e.g., the third, cutting diameter position wherein the collar 7 and both the notches 13*c* and 14*c* are engaged or mated with each other. FIG. 7B illustrates the step of releasing or un-mating or disengaging the collar 7 and both the notches 13*c* and 14*c* from each other by displacing the collar 7 away or proximally from the blades 13 and 14, i.e., away or proximally from the notches 13*c* and 14*c*, such as in the direction illustrated by the arrows 701 and 702. FIG. 7C illustrates the step of narrowing or decreasing or reducing the cutting diameter of the blades 13 and 14, i.e., of the broadhead 100, after the collar 7 and both notches 13*c* and 14*c* have been disengaged from each other. As illustrated, the cutting diameter is decreased by moving the proximal edge or end of each blade 13 and 14 in the direction illustrated by arrows 703 and 704, respectively. As described with reference to at least FIGS. 4 and 5, at least a portion of each blade 13 and 14 extends through respective passage, e.g., passage 15, into the broadhead body 11. At least portions of the blades 13 and 14 are positioned into the broadhead body 11 while retaining the notches 13*b* and 14*b* or the notches 13*a* and 14*a* exposed adjacent the broadhead body 11. The collar 7 is then displaced distally towards proximal edges or ends of the blades 13 and 14, i.e., distally towards the exposed notches 13*a* and 14*a* or the exposed notches 13*b* and 14*b*, for engaging or mating the exposed notches and the collar 7 with each other. For example, FIG. 7D illustrates the displacement of the collar 7 distally towards the notches 13*a* and 14*a* such as in the direction illustrated by the arrows 706 and 706. As illustrated, the collar 7 and the notches 13*a* and 14*a* engage with each other, thereby configuring the two-bladed broadhead 100 for the narrowest, e.g., the first, cutting diameter. Of course, the broadhead 100 is configurable for a cutting diameter between the widest and the narrowest cutting diameters by engaging or mating the collar 7 and both notches 13*b* and 14*b* with each other.

While the method or process described with reference to FIGS. 7A-7D may appear to imply that both the blades 13 and 14 are set at the same cutting diameter as defined by any one of the pair of notches 13*a* and 14*a* or 13*b* and 14*b* or 13*c* and 14*c*, this should not be considered as being limiting in any sense or form. It should be apparent that the cutting diameter of the broadhead 100 is defined by the position of each blade 13 and 14, i.e., the position of respective notches 13*a*-13*c* and 14*a*-14*c* relative to the broadhead body 11. As such, both blades 13 and 14 do not have to be set for substantially similar cutting diameter. For instance, in a non-limiting exemplary embodiment, one of the blades 13 or 14 can be set at one of the three cutting diameters, as defined by the notches a-c, and the other of the blades 13 and 14 can be set at a different cutting diameter, again as defined by the notches a-c. For example, the broadhead 100 can be configured with the blade 13 set for the narrowest cutting diameter and the blade 14 set for the widest cutting diameter. Such a configuration is provided by engaging or mating the collar 7 and the notches 13*a* and 14*c* with each other. Thus, a plurality of configurations in which the two-bladed broadhead 100 is simultaneously set for one or more cutting diameters are available by individually setting the cutting diameter of each blade.

Furthermore, while both blades 13 and 14 are illustrated having substantially similar shapes, dimensions and/or configurations, this is not a requirement. In some non-limiting exemplary embodiments, each blade 13 and 14 has its own unique shape, dimension and/or configuration that is different from that of the other.

Figure 8A:
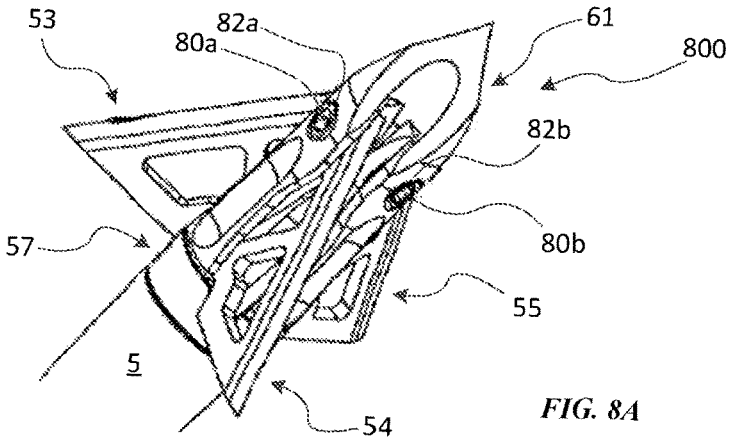
FIG. 8A is a perspective view of a non-limiting exemplary embodiment of a three-bladed broadhead with the blades in a first cutting diameter position.
Figure 8B:
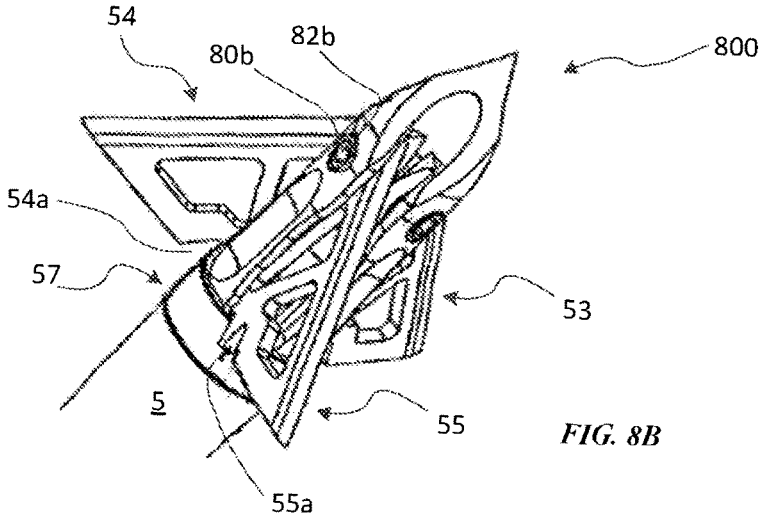
FIG. 8B is a perspective view of the three-bladed broadhead of FIG. 8A with the blades in a second cutting diameter position.
Figure 8C:
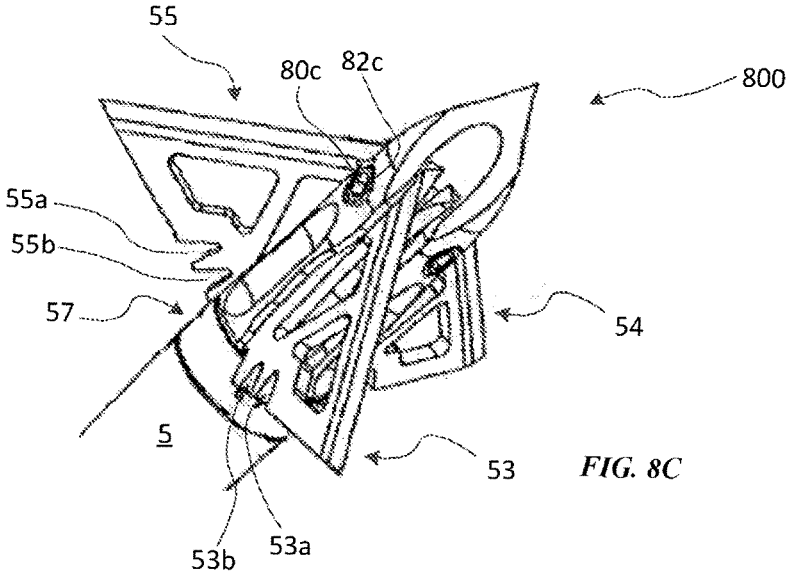
FIG. 8C is a perspective view of the three-bladed broadhead of FIG. 8A with the blades in a third cutting diameter position.
Figure 9A:
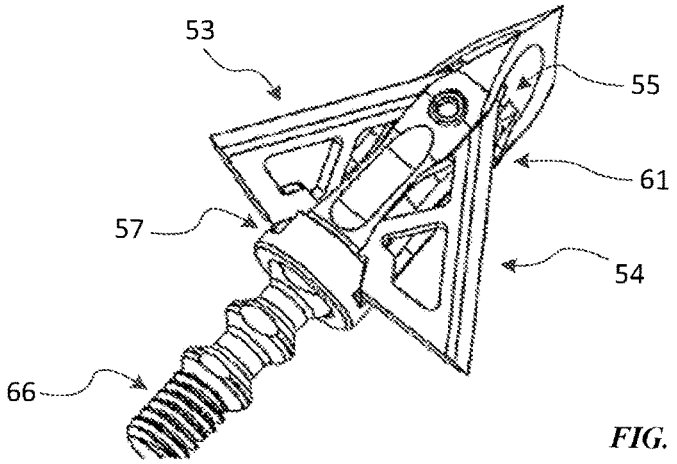
FIG. 9A is a perspective view of a non-limiting exemplary embodiment of a three-bladed broadhead with a notched collar positioned over a threaded portion of the rear arrow shaft attachment end, holding the blades in a first cutting diameter position.
Figure 9B:
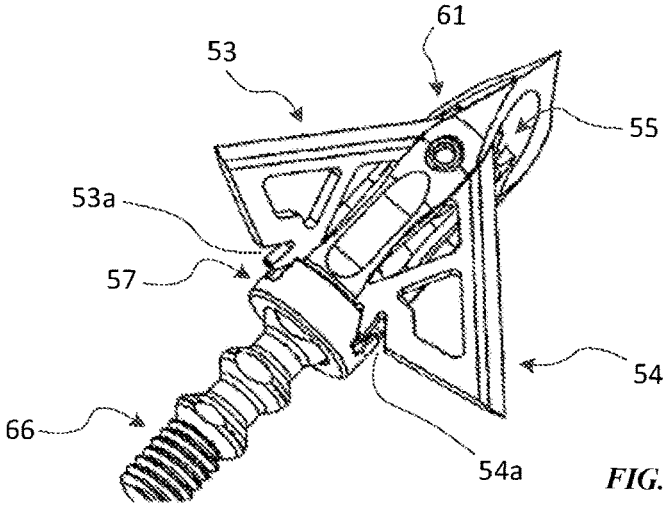
FIG. 9B is a perspective view of the three-bladed broadhead of FIG. 9A with the blades held in a second cutting diameter position.
Figure 9C:
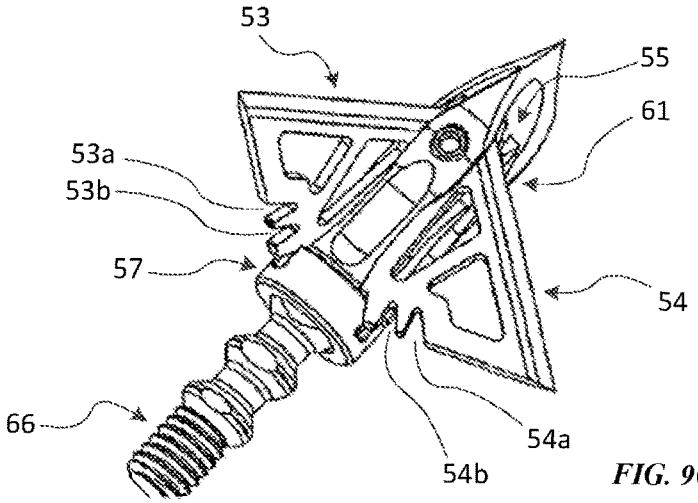
FIG. 9C is a perspective view of the three-bladed broadhead of FIG. 9A with the blades held in a third cutting diameter position.

FIGS. 8A and 9A are perspective views of a non-limiting exemplary embodiment of a three-bladed broadhead 800 with the blades 53, 54 and 55 held in a first cutting diameter position by respective notches 53*a*, 54*a* and 55*a* engaged or mated with the collar 57. FIGS. 8B and 9B are perspective views of the three-bladed broadhead 800 with blades 53, 54 and 55 held in a second cutting diameter position by respective notches 53*b*, 54*b* and 55*b* engaged or mated with the collar 57. FIGS. 8C and 9C are perspective views of the three-bladed broadhead 800 with blades 53, 54 and 55 held in a third cutting diameter position by respective notches 53*c*, 54*c* and 55*c* mated or engaged with the collar 57.

As with blades 13 and 14, the notches 53*a*-53*c*, 54*a*-54*c* and 55*a*-55*c* are along a proximal edge or end of respective blades 53, 54 and 55. Also as with blades 13 and 14, a distal end or portion of each blade 53, 54 and 55 is pivotally attached to a broadhead body 61 of the three-bladed broadhead 800. For instance, as illustrated in FIGS. 8A-8C and 9A-9C, a distal end of each blade 53, 54 and 55 is pivotally attached to the broadhead body 61 by respective pins 80*a*-80*c* disposed in respective bores 82*a*-82*c* defined through the broadhead body 61. In some non-limiting exemplary embodiments, the distal end of the blades 53, 54 and 55 are pivotally attached to the broadhead body 61 by a set screw or other suitable conventional means such as a dowel pin or a roll pin.

In some non-limiting exemplary embodiments of the three-bladed broadhead 800, such as that illustrated in FIGS. 8A-8C, the collar 57 is mounted on a shaft of an arrow or on a crossbow bolt 5. In certain non-limiting exemplary embodiments, such as that illustrated in FIGS. 9A-9C, the collar 57 is mounted on or positioned over a portion of a threaded attachment end 66 extending proximally from the broadhead body 61. The threaded portion of the attachment end 66 is configured for threadingly mounting or attaching the three-bladed broadhead 800 an arrow shaft or a broadhead bolt 5. In some non-limiting exemplary embodiments, the collar 57 is a notched collar 57 as described with reference to FIGS. 10A and 10B.

While blades 53, 54 and 55 are illustrated having substantially similar shapes, dimensions and/or configurations, this is not a requirement. In some non-limiting exemplary embodiments, each blade 53, 54 and 55 has its own unique shape, dimension and/or configuration that is different from that of the others.

Figure 10A:
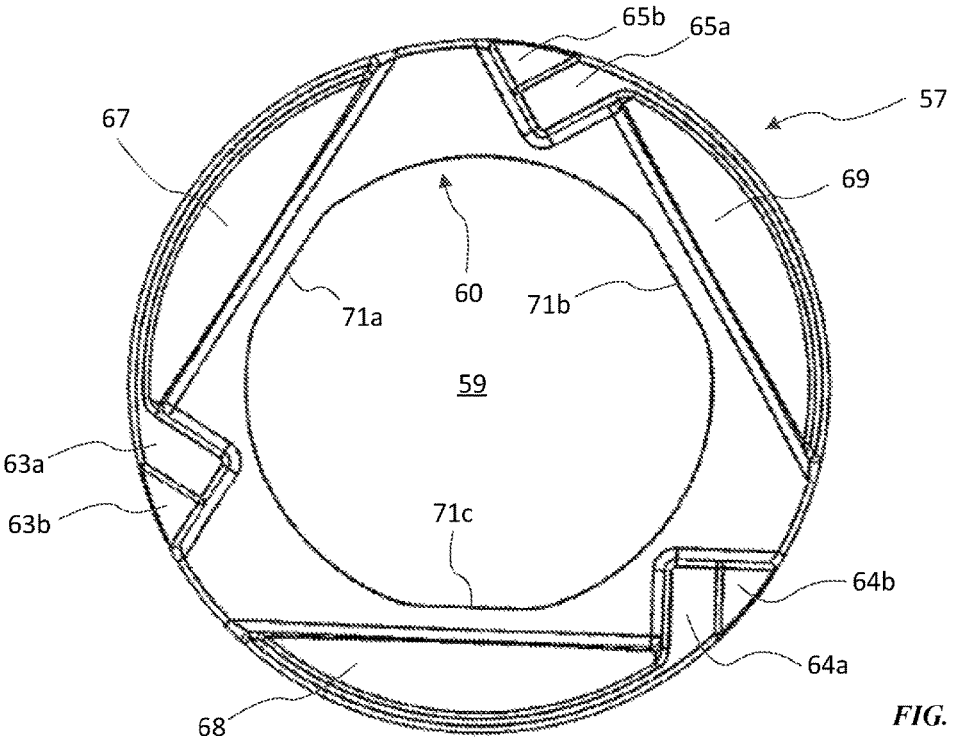
FIG. 10A is a top view of a non-limiting exemplary embodiment of a collar used to index and retain the blades on the three-bladed broadheads shown in FIGS. 8A-8C and 9A-9C.
Figure 10B:
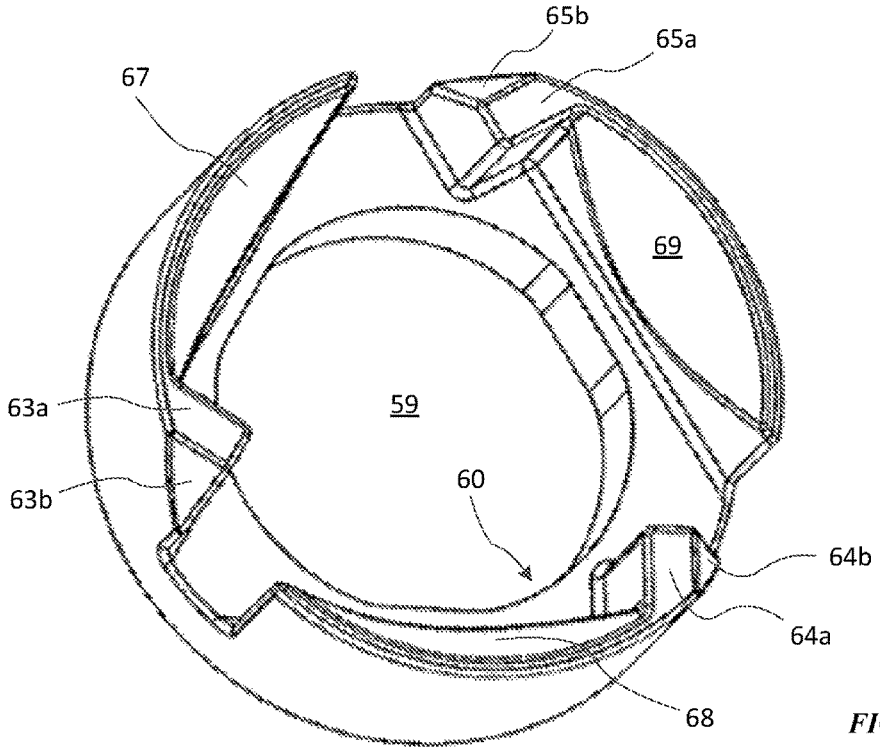
FIG. 10B is a perspective view of the collar illustrated in FIG. 10A.

FIG. 10A is a top view of a non-limiting exemplary embodiment of the collar 57 used for indexing and retaining the blades 53, 54 and 55 in the first, second and third cutting diameter positions such as those illustrated in FIGS. 8A-8C and 9A-9C. FIG. 10B is a perspective view of the collar 57 illustrated in FIG. 10A. Collar tab 63*a* and tab angle 63*b* mate and engage with notches 53*a*-53*c*, respectively, when the blade 53 is in the first, second and third cutting diameter position. Likewise, collar tab 64*a* and 64*b* mate and engage with notches 54*a*-54*c*, respectively, when the blade 54 is in the first, second and third cutting diameter position. And, collar tab 65*a* and tab angle 65*b* mate and engage with notches 55*a*-55*c*, respectively, when the blade 55 is in the first, second and third cutting diameter position.

Figure 16:
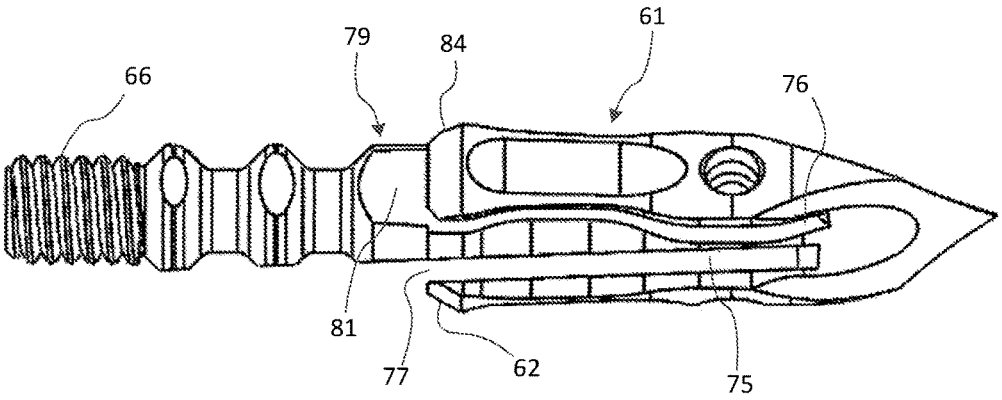
FIG. 16 is a perspective view of the body of the three-bladed broadhead of FIGS. 9A-9C and 11A-11C.

In some non-limiting exemplary embodiments, the collar 57 has an opening 59 that is adapted to receive the threaded attachment end 66 extending proximally from the broadhead body 61. The opening 59 is defined, at least in part, by an inner perimeter 60 of the collar 57. As illustrated in FIG. 16, the inner perimeter 60 includes linear portions 71*a*-71*c* that fit over face 81, and the inner perimeter includes sloped surface 68 that fits over sloped surface 84 of the broadhead body 61.

Figure 11A:
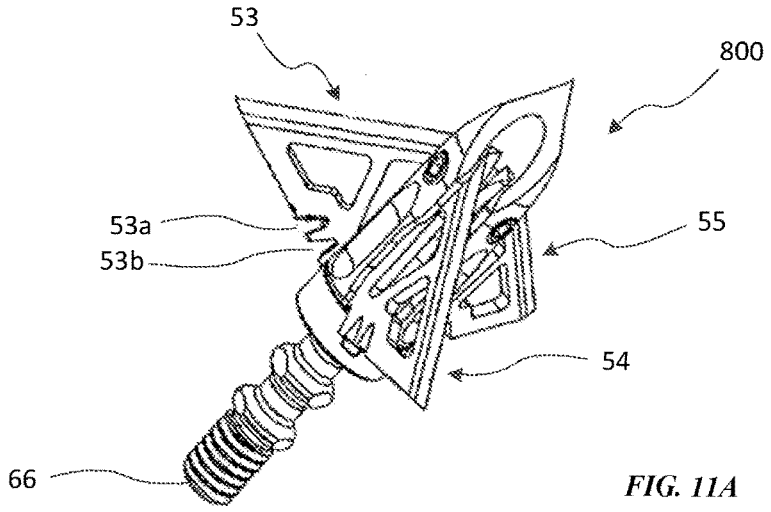
FIG. 11A is a perspective view of a non-limiting exemplary embodiment of a three-bladed broadhead with the blades positioned in a wide cutting diameter position.
Figure 11B:
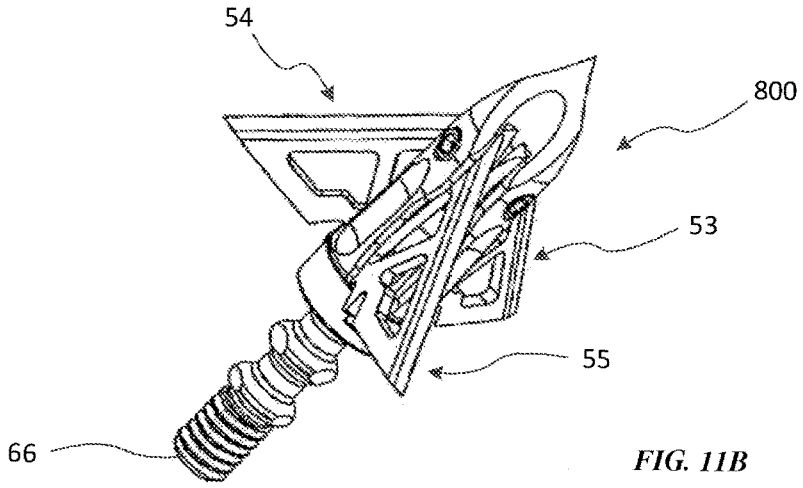
FIG. 11B is a perspective view of the three-bladed broadhead of FIG. 11A with the blades held in a middle cutting diameter position.
Figure 11C:
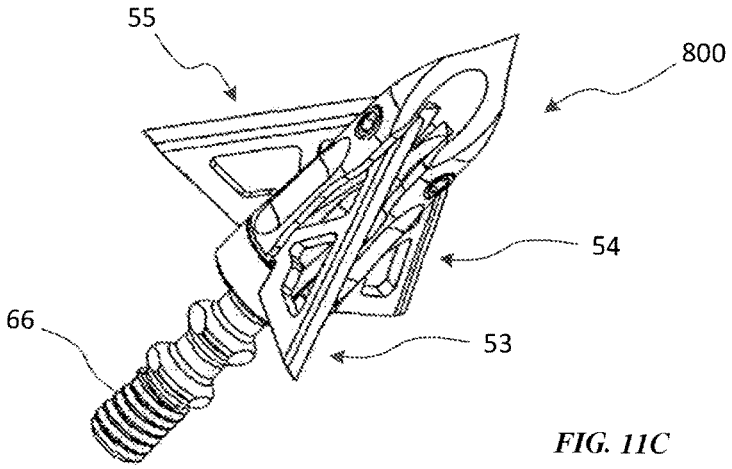
FIG. 11C is a perspective view of the three-bladed broadhead of FIG. 11A with the blades held in a narrow cutting diameter position.

FIG. 11A is a perspective view of a non-limiting exemplary embodiment of the broadhead 800 with the blades 53, 54 and 55 positioned in a wide cutting diameter position. FIG. 11B is a perspective view of the broadhead 800 with the blades 53, 54 and 55 positioned in a middle cutting diameter position. FIG. 11C is a perspective view of the broadhead 800 with the blades 53, 54 and 55 positioned in a narrow cutting diameter position.

Figure 12:
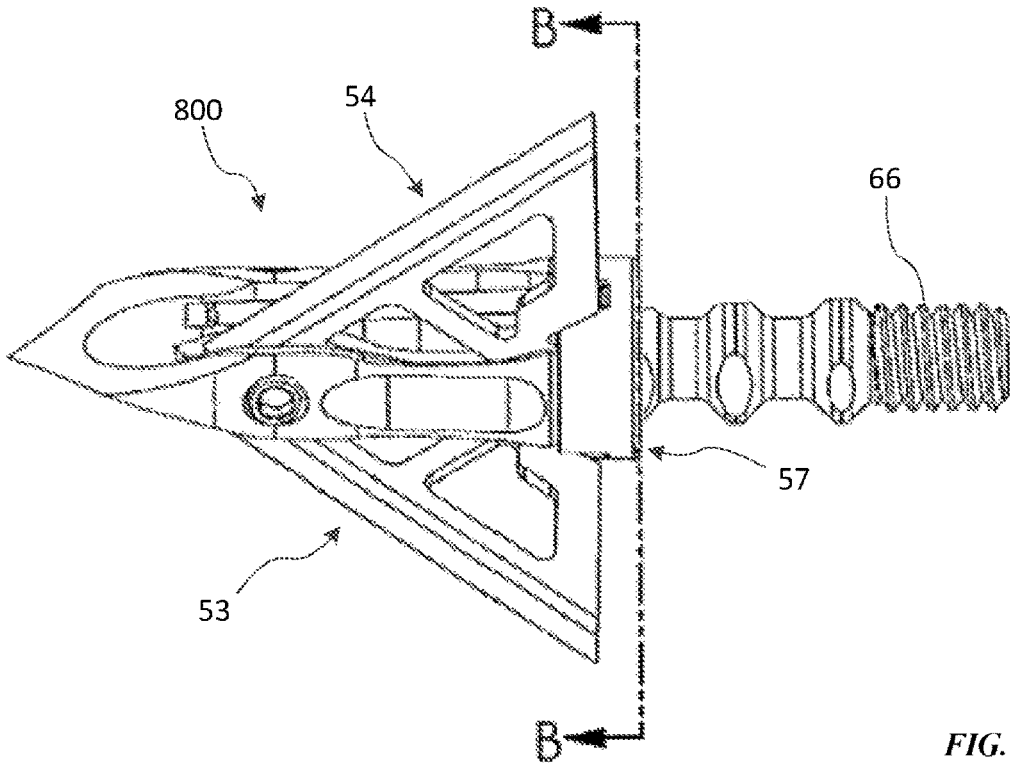
FIG. 12 is a side view of the three-bladed broadhead of FIGS. 9A-9C and 11A-11C.
Figure 13:
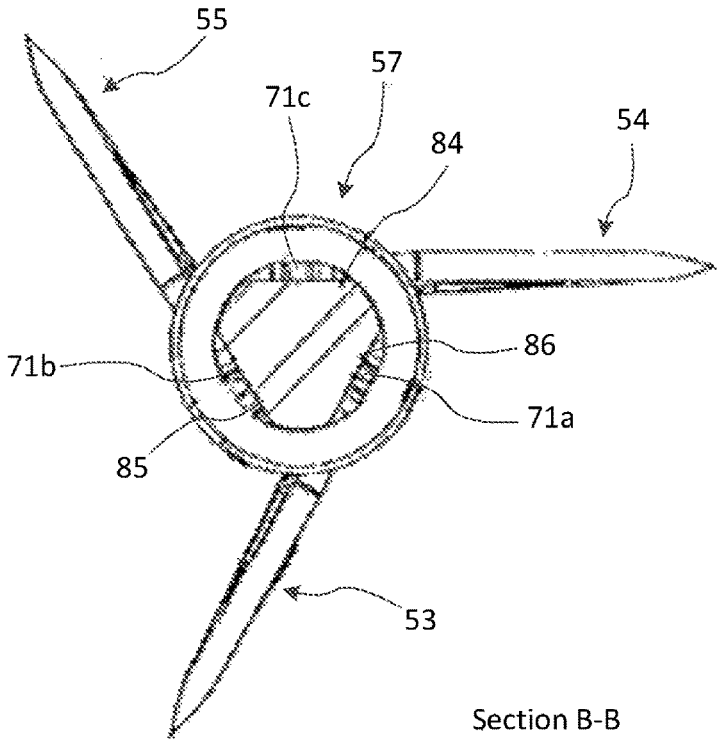
FIG. 13 is a cross-sectional view of the three-bladed broadhead of FIG. 12, taken at line B-B.

FIG. 12 is a side view of the broadhead of FIGS. 9A-9C and 11A-11C, and FIG. 13 is a cross-sectional view along line B-B of the broadhead illustrated in FIG. 12. In a non-limiting exemplary embodiment, linear portion 71*a* fits over face 86 of the broadhead body 61, linear portion 71*b* fits over face 85 of the broadhead body 61, and linear portion 71*c* fits over face 84 of the broadhead body 61. In some non-limiting exemplary embodiments, the diameter of the inner perimeter 60 and the diameter of the linear portions 71*a*-71*c* is slightly larger than the respective diameter of the base 79, the diameter of face 81, and the diameters of the face (not shown) positioned adjacent the linear portions 71 and 71*b*. However, the diameter of the inner perimeter 60 and the diameters of the linear portions 71*a*-71*c* have the same or slightly smaller dimensions than the respective diameters of base 79, face 81, and the faces (not shown) positioned adjacent to the linear portions 71*a*-71*b*.

Figure 14:
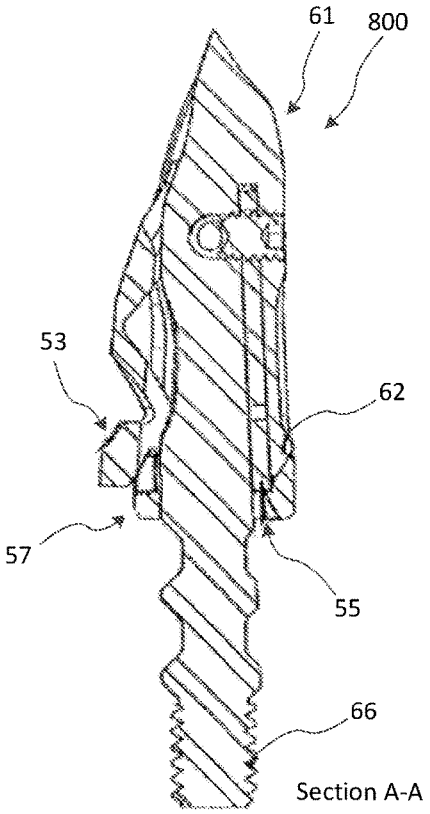
FIG. 14 is a cross-sectional view of the three-bladed broadhead of FIG. 15, taken at line A-A.
Figure 15:
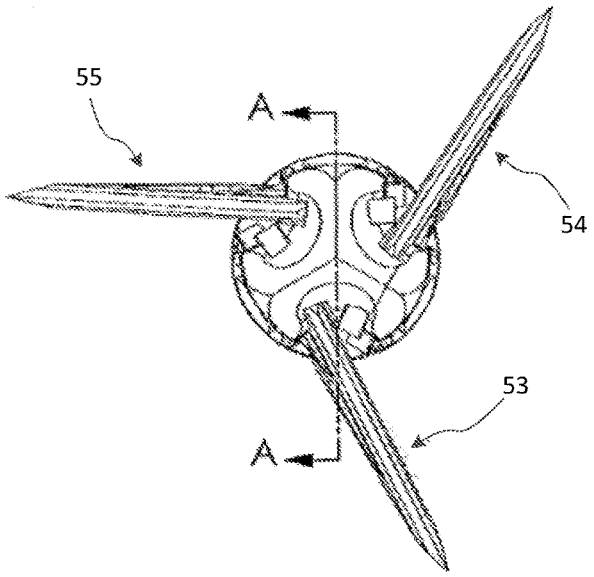
FIG. 15 is a top view of the three-bladed broadhead of FIGS. 9A-9C and 11A-11C.

FIG. 15 is a top view of a non-limiting exemplary embodiment of the broadhead 800 illustrated in FIGS. 9A-9C and 11A-11C. FIG. 14 is a cross-sectional view along line A-A of the broadhead 800 illustrated in FIG. 15. As illustrated in FIG. 14, the collar 57 engages one of the tabs 62 (shown in FIG. 16) on the broadhead body 61 to create an inward force on the tab 62.

FIG. 16 is a perspective view of the broadhead body 61 of the broadhead 800 illustrated in FIGS. 9A-9C and 11A-11C. Transverse passages 75, 76 have an opening at one end of each transverse passage, such as opening 77 of transverse passage 75, shown in FIG. 13, that allows for the tabs (e.g., tab 62) on the broadhead body 61 to be compressed perpendicular to the overall axis of the ferrule as the collar 57 is slid onto the broadhead body 61, thereby further clamping each blade 53, 54 and 55 in place.

At least a portion of the blade 54 is illustrated as contained or housed within the transverse passage 76, and at least a portion of the blade 55 is illustrated as contained or housed within the transverse passage 75. At least a portion of the blade 53 is also contained in a third transverse passage (not shown) of the broadhead body 61. In a non-limiting exemplary embodiment, broadhead body 61 has three transverse passages positioned at 120 degrees around the longitudinal centerline of the broadhead body 61. The transverse passages 75, 76 (and passage for blade 53, which is not shown) allow for the respective blades 55, 54 and 53 to be positioned or housed within their respective transverse passages and to pivot therethrough without obstruction.

Figure 17A:
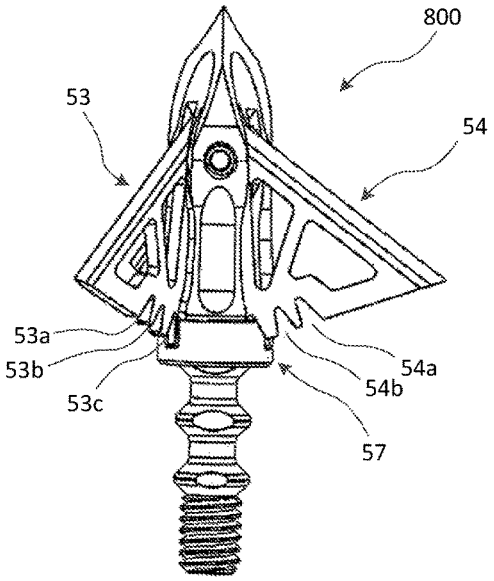
FIGS. 17A-17D illustrate a non-limiting exemplary embodiment of a process of moving the blades of the three-bladed broadheads of FIGS. 9A-9C and 11A-11C from one position to another.
Figure 17B:
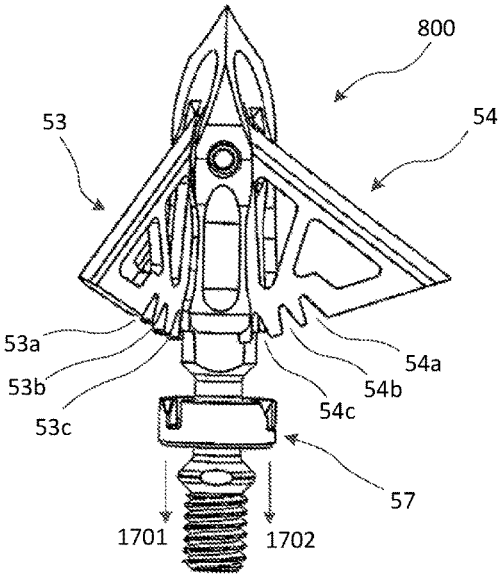
Figure 17C:
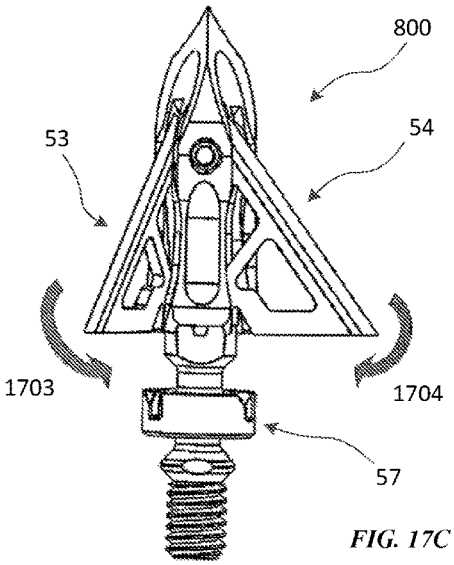
Figure 17D:
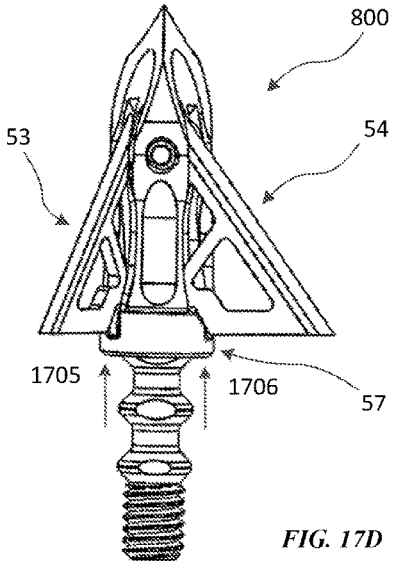

FIGS. 17A-17D illustrate a non-limiting exemplary embodiment of a method or process of moving the blades 53, 54 and 55 from one position to another in the three-bladed broadhead 800 of FIGS. 9A-9C and 11A-11C. FIG. 17A shows the three-bladed broadhead 800 with the blades 53, 54 and 55 (not shown) in a wide cutting diameter position with the collar 57 and the three notches 53*c*, 54*c* and 55*c* (not shown) mated or engaged with each other. FIG. 17B illustrates the step of releasing or un-mating or disengaging the collar 57 and the three notches 53*c*, 54*c* and 55*c* from each other by displacing the collar 57 proximally (or away) from the blades 53, 54 and 55, i.e., proximally (or away) from the notches 53*c*, 54*c* and 55*c*, such as in the direction illustrated by the arrows 1701 and 1702. FIG. 17C illustrates the step of narrowing or decreasing or reducing the cutting diameter of the three-bladed broadhead 800, i.e., of the blades 53, 54 and 55, after the collar 57 and the notches 53*c*, 54*c* and 55*c* have been disengaged from each other. As illustrated, the cutting diameter is decreased by moving the proximal edges or ends of the blades 53 and 54 (and 55 not shown) in the direction illustrated by the arrows 1703 and 1704. As described at least with reference to FIG. 16, at least a portion of each blade 53, 54 and 55 extends into respective transverse passages in the broadhead body 61. Thus, at least a portion of the blades 53, 54 and 55 are placed or housed within the broadhead body 61 while retaining the notches 53*b*, 54*b* and 55*b* or the notches 53*a*, 54*a* and 55*a* exposed adjacent the broadhead body 61. The collar 57 is then displaced distally, i.e., towards, the proximal edges or ends of the blades 53, 54 and 55, i.e., distally or towards the exposed notches 53*b*, 54*b* and 55*b* or the exposed notches 53*a*, 54*a* and 55*a*, for mating or engaging the collar 57 and the exposed notches with each other. For example, FIG. 17D illustrates the displacement of the collar 57 proximally towards the proximal edges or ends of the blades 53 and 54 (and blade 55), i.e., proximally towards the exposed notches 53*a* and 54*a* (and 55*a*), such as in the direction illustrated by the arrows 1705 and 1706. The three-bladed broadhead 800 illustrated in FIG. 17D is thus configured for the narrowest cutting diameter. Of course, as with the method or process described with reference to FIGS. 7A-7D for the two-bladed broadhead 100, the three-bladed broadhead is also configurable for any one of the cutting diameters between the widest and the narrowest cutting diameter by engaging or mating the collar 57 and any one of the notches 53*a*-53*c*, 54*a*-54*c* and 55*a*-55*c* with each other.

While the method or process described with reference to FIGS. 17A-17D may appear to imply that the blades 53, 54 and 55 are set at the same cutting diameter as defined by any one of the notches 53*a*, 54*a* and 55*a*, or 53*b*, 54*b* and 55*b*, or 53*c*, 54*c* and 55*c*, such positioning of the notches should not be considered as being limiting in any sense or form. It should be readily apparent that the cutting diameter of the three-bladed broadhead 800 is defined by the position of each blade 53, 54 and 55, i.e., the position of the respective notches 53*a*-53*c*, 54*a*-54*c* and 55*a*-55*c* relative to the broadhead body 61. As such, the three blades 53, 54 and 55 do not have to be set for substantially similar cutting diameter. For instance, in a non-limiting embodiment, each blade 53, 54 and 55 can be set at one of the three cutting diameters defined by its respective notches a-c. For example, the three-bladed broadhead 800 can be configured with the blade 53 set at the narrowest cutting diameter by engaging or mating the notch 53*a* and the collar 57 with each other, the blade 54 set at a cutting diameter between the narrowest and widest by engaging or mating the notch 54*b* and the collar 57 with each other, and the blade 55 set at the widest cutting diameter by engaging or mating the notch 55*c* and the collar 57 with each other. Thus, a plurality of configurations in which the three-bladed broadhead 800 is set for one or more cutting diameters are available by individually setting the cutting diameter of each blade.

In view thereof, modified and/or alternate configurations of the embodiments described herein may become apparent or obvious. All such variations are considered as being within the metes and bounds of the instant disclosure. For instance, while reference may have been made to particular feature(s) and/or function(s), the disclosure is considered to also include embodiments configured for functioning and/or providing functionalities similar to those disclosed herein with reference to the accompanying drawings. Accordingly, the spirit, scope and intent of the instant disclosure is to embrace all such variations. Consequently, the metes and bounds of the disclosure is solely defined by the appended claims and any and all equivalents thereof.

What is claimed is:

1. A broadhead, comprising:

a broadhead body comprising:

a shaft having a distal end and a proximal end, wherein the distal end is configured for penetrating a target; and a plurality of longitudinally extending recesses disposed on the shaft;

a plurality of blades, each comprising:

a longitudinally extending edge disposed within one of the plurality of recesses;

a distal end pivotally attached to the shaft proximate the distal end thereof;

a proximal edge extending outwardly from the longitudinal edge of the blade disposed within the recess;

a plurality of notches disposed along the proximal edge of the blade; and an outwardly directed cutting surface; and a collar adjustably disposed about the shaft of the broadhead body proximate the proximal end thereof, the collar configured for engaging with one of the plurality of notches disposed along the proximal edge of each of the plurality of blades.

2. The broadhead of claim 1, wherein a cutting diameter of each of the plurality of blades is adjustable.

3. The broadhead of claim 2, wherein a cutting diameter of the broadhead is defined at least in part by the cutting diameter of each of the plurality of blades.

4. The broadhead of claim 3, wherein the cutting diameter of the broadhead is adjustable.

5. The broadhead of claim 2, wherein the cutting diameter of each of the plurality of blades is defined at least in part by a distance that each blade's proximal edge extends outwardly.

6. The broadhead of claim 5, wherein the distance that each blade's proximal edge extends outwardly is adjusted by rotating the blade about its distal end.

7. The broadhead of claim 6, wherein the cutting diameter of each of the plurality of blades is temporarily fixed by engaging the collar with one of the plurality of notches disposed along the proximal edge of the blade.

8. The broadhead of claim 7, wherein the collar is biased towards the proximal edge of each of the plurality of blades.

9. The broadhead of claim 8, wherein pulling the collar proximally away from the proximal edges of the plurality of blades disengages the collar from each notch the collar was engaged with; and releasing the collar displaces it distally towards the proximal edges of the plurality of blades.

10. The broadhead of claim 7, wherein the collar and the broadhead body comprise an interlock configured for retaining the collar in engagement with the plurality of notches.

11. The broadhead of claim 6, wherein each of the plurality of longitudinally extending recesses disposed on the shaft is configured to house at least a portion of at least one of the plurality of blades as the blade rotates about its distal end.

12. The broadhead of claim 2, wherein the cutting diameter of each of the plurality of blades are adjustable independently of each other.

13. The broadhead of claim 2, wherein the collar comprises a plurality of detents; and each detent is configured for engaging one of the plurality of notches disposed along the proximal edge of one of the plurality of blades.

14. The broadhead of claim 2, wherein the cutting diameter of each of the plurality of blades is adjusted by displacing at least a portion of the blade into or out of its corresponding recess in the shaft of the broadhead body.

15. A method of adjusting a cutting diameter of a broadhead, comprising:

providing a broadhead body, comprising:

a shaft having a distal end and a proximal end, wherein the distal end is configured for penetrating a target; and a plurality of longitudinally extending recesses disposed on the shaft;

providing a plurality of blades, each comprising:

a longitudinally extending edge disposed within one of the plurality of recesses;

a distal end pivotally attached to the shaft proximate the distal end thereof;

a proximal edge extending outwardly from the longitudinal edge of the blade;

a plurality of notches disposed along the proximal edge of the blade; and an outwardly directed cutting surface;

providing a collar adjustably disposed about the shaft of the broadhead body proximate the proximal end thereof, the collar configured for engaging with one of the plurality of notches disposed along the proximal edge of each of the plurality of blades;

disengaging the collar from each of the notches;

adjusting a cutting diameter of each of the plurality of blades by rotating the blade about its distal end; and engaging the collar with one of the plurality of notches disposed along the proximal edge of each of the plurality of blades.

16. The method of claim 15, comprising adjusting the cutting diameter of each of the plurality of blades independently of each other.

17. The method of claim 16, comprising adjusting a cutting diameter of the broadhead by adjusting a cutting diameter of each of the plurality of blades.

18. The method of claim 15, wherein adjusting the cutting diameter of each blade comprises adjusting a distance that each blade's proximal edge extends outwardly.

19. The method of claim 15, wherein adjusting the cutting diameter of each blade comprises displacing at least a portion of the blade into or out of its corresponding recess in the shaft of the broadhead body.

* * * * *